US007531054B2

(12) United States Patent
Kennedy et al.

(10) Patent No.: US 7,531,054 B2
(45) Date of Patent: May 12, 2009

(54) NICKEL ALLOY AND METHOD INCLUDING DIRECT AGING

(75) Inventors: Richard L. Kennedy, Monroe, NC (US); Wei-Di Cao, Charlotte, NC (US)

(73) Assignee: ATI Properties, Inc., Albany, OR (US)

( * ) Notice: Subject to any disclaimer, the term of this patent is extended or adjusted under 35 U.S.C. 154(b) by 343 days.

(21) Appl. No.: 11/221,028

(22) Filed: Sep. 6, 2005

(65) Prior Publication Data

US 2007/0044875 A1 Mar. 1, 2007

Related U.S. Application Data

(60) Provisional application No. 60/710,806, filed on Aug. 24, 2005.

(51) Int. Cl.
*C22F 1/10* (2006.01)
*C22C 19/05* (2006.01)

(52) U.S. Cl. ..... 148/677; 148/410; 148/428; 420/447; 420/449; 420/450; 420/588

(58) Field of Classification Search ..... None
See application file for complete search history.

(56) References Cited

U.S. PATENT DOCUMENTS 3,046,108 A 7/1962 Eiselstein
3,677,830 A 7/1972 Cox et al.
3,705,827 A * 12/1972 Muzyka et al. ..... 148/607
3,975,219 A 8/1976 Allen et al.
4,083,734 A 4/1978 Boesch
4,144,102 A 3/1979 Smith, Jr. et al.
4,219,592 A 8/1980 Anderson et al.
4,236,943 A 12/1980 Korenko et al.

(Continued)

FOREIGN PATENT DOCUMENTS

RU 1360232 C 8/1994

(Continued)

OTHER PUBLICATIONS

ASM Handbook (vol. 14, fourth printing, (1996), electronic file, p. 1-18).*

(Continued)

*Primary Examiner*—Roy King
*Assistant Examiner*—Mark L Shevin
(74) *Attorney, Agent, or Firm*—Kirkpatrick & Lockhart Preston Gates Ellis LLP; Patrick J. Viccaro; John E. Grosselin, III

(57) ABSTRACT

Embodiments of the present disclosure relate to nickel-base alloys and methods of direct aging nickel-base alloys. More specifically, certain embodiments of the present disclosure relate to methods of direct aging 718Plus® nickel-base alloy to impart improved mechanical properties, such as, but not limited to, tensile strength, yield strength, low cycle fatigue, fatigue crack growth, and creep and rupture life to the alloys. Other embodiments of the present disclosure relate to direct aged 718Plus® nickel-base alloy, and articles of manufacture made therefrom, having improved mechanical properties, such as, but not limited to, tensile strength, yield strength, low cycle fatigue, fatigue crack growth, and creep and rupture life.

35 Claims, 1 Drawing Sheet

U.S. PATENT DOCUMENTS

| | | | | | |
|---|---|---|---|---|---|
| 4,371,404 | A | | 2/1983 | Duhl et al. | |
| 4,608,094 | A | * | 8/1986 | Miller et al. | 148/677 |
| 4,614,550 | A | | 9/1986 | Leonard et al. | |
| 4,624,716 | A | | 11/1986 | Noel et al. | |
| 4,652,315 | A | | 3/1987 | Igarashi et al. | |
| 4,750,944 | A | | 6/1988 | Snyder et al. | |
| 4,777,017 | A | | 10/1988 | Khan et al. | |
| 4,788,036 | A | * | 11/1988 | Eiselstein et al. | 420/448 |
| 4,793,868 | A | | 12/1988 | Chang | |
| 4,798,632 | A | | 1/1989 | Yonezawa et al. | |
| 4,814,023 | A | | 3/1989 | Chang | |
| 4,837,384 | A | | 6/1989 | Khan et al. | |
| 4,888,253 | A | | 12/1989 | Snyder et al. | |
| 4,981,644 | A | | 1/1991 | Chang | |
| 5,006,163 | A | | 4/1991 | Benn et al. | |
| 5,047,091 | A | | 9/1991 | Khan et al. | |
| 5,077,004 | A | | 12/1991 | Schweizer et al. | |
| 5,087,305 | A | | 2/1992 | Chang | |
| 5,104,614 | A | | 4/1992 | Ducrocq et al. | |
| 5,129,970 | A | | 7/1992 | Henry et al. | |
| 5,131,961 | A | * | 7/1992 | Sato et al. | 148/677 |
| 5,154,884 | A | | 10/1992 | Wukusick et al. | |
| 5,156,808 | A | | 10/1992 | Henry et al. | |
| 5,244,515 | A | | 9/1993 | Miglin | |
| 5,328,659 | A | | 7/1994 | Tillman et al. | |
| 5,403,546 | A | | 4/1995 | Khan et al. | |
| 5,424,029 | A | | 6/1995 | Kennedy et al. | |
| 5,431,750 | A | | 7/1995 | Kawai et al. | |
| 5,435,861 | A | | 7/1995 | Khan et al. | |
| 5,556,594 | A | * | 9/1996 | Frank et al. | 420/448 |
| 5,863,494 | A | | 1/1999 | Nazmy et al. | |
| 5,888,315 | A | | 3/1999 | Ishii et al. | |
| 5,888,316 | A | | 3/1999 | Erickson | |
| 5,916,382 | A | | 6/1999 | Sato et al. | |
| 6,106,767 | A | | 8/2000 | Kennedy et al. | |
| 6,193,823 | B1 | | 2/2001 | Morra | |
| 6,315,846 | B1 | | 11/2001 | Hibner et al. | |
| 6,328,827 | B1 | | 12/2001 | Bouzidi et al. | |
| 6,416,564 | B1 | | 7/2002 | Bond et al. | |
| 6,496,529 | B1 | | 12/2002 | Jones et al. | |
| 6,531,002 | B1 | | 3/2003 | Henry et al. | |
| 6,605,164 | B2 | | 8/2003 | Kennedy et al. | |
| 6,719,858 | B2 | | 4/2004 | Bond et al. | |
| 6,730,264 | B2 | * | 5/2004 | Cao | 420/448 |
| 6,755,924 | B2 | | 6/2004 | Harrison et al. | |
| 6,997,994 | B2 | | 2/2006 | Sudo | |
| 2001/0026769 | A1 | | 10/2001 | Kobayashi et al. | |
| 2005/0072500 | A1 | * | 4/2005 | Cao et al. | 148/675 |
| 2007/0029014 | A1 | * | 2/2007 | Cao et al. | 148/410 |
| 2007/0029017 | A1 | * | 2/2007 | Cao et al. | 148/675 |

FOREIGN PATENT DOCUMENTS

| | | | |
|---|---|---|---|
| RU | 2088684 | C1 | 8/1997 |
| RU | 2112069 | C1 | 5/1998 |
| WO | WO03097888 | A | 11/2003 |
| WO | WO2005038069 | A | 4/2005 |

OTHER PUBLICATIONS

J.F. Barker et al. Thermomechanical processing of Inconel 718 and its Effect on Properties. Advanced High Temperature Alloy: Processing and Properties, ASM (1986), p. 125-137.).*

R.L. Kennedy et al. Developments in Wrought Nb Containing Superalloys (718+ 100 F). Proceedings of the International Symposium on Niobium for High Temperature Application, Araxa, Brazil, Dec. 1-3, 2003, Published by TMS, indexed by Chemical Abstracts Service, Oct. 25, 2004.*

Allvac 718 alloy technical data sheet Dec. 31, 2001.*

Allvac 718Plus alloy technical data sheet May 6, 2005.*

Allvac 718PLus alloy technical data sheet, Aug. 3, 2005.*

B.J. Bond and R.L. Kennedy, Evaluation of Allvac® 718PLUSTM alloy in the cold worked and heat treated condition, Superalloys 718, 628, 706, and Derivatives 2005, ed. E.A. Loria, The Minerals, Metals, and Materials Society, 2005, 10 pages.*

J.H. Du et al. Microstructure and mechanical properties of novel 718 superalloy. Acta. Metallurgica Sinica, vol. 19, No. 6, Dec. 2006, p. 418-424.*

E. Guo et al. Improving thermal stability of alloy 718 via small modifications in composition. Superalloy 718—Metallurgy and Applications, ed. E.A. Loria, The Minerals, Metals and Materials Society, 1989, p. 567-576.*

R.L. Kennedy, Allvac® 718PLUSTM , superalloy for the next forty years, Superalloys 718, 628, 706, and Derivatives 2005, ed. E.A. Loria, The Minerals, Metals, and Materials Society, 2005, 14 pages.*

J. Warren and D.Y. Wei. The cyclic fatigue behavior of direct age 718 at 149, 315, 454, and 538° C. Materials Science and Engineering A. vol. 428, (2006), p. 106-115.*

M.G. Burke et al., "Microstructure and Properties of Direct-Aged Alloy 625," in Superalloys 718, 625, 706 and Various Derivatives, E.A. Loria Ed., The Minerals, Metals & Materials Society, 2001, pp. 389-398.

J.F. Radavich et al., "Effects of Processing and Thermal Treatments on Alloy 720," in Proceedings of the Tenth International Conference on Vacuum Metallurgy, vol. 1, Beijing, P.R. China, 1990, pp. 42-53.

W. Horvath et al., "The Effectiveness of Direct Aging on Inconel 719 Forgings Produced at High Strain Rates as Obtained on a Screw Press," in Superalloys 718, 625, 706 and Various Derivatives, E.A. Loria Ed., The Minerals, Metals & Materials Society, 2001, pp. 223-228.

D.D. Krueger, The Development of Direct Age 718 for Gas Turbine Engine Disk Applications, in Superalloy 718—Metallurgy and Applications, E.A. Loria Ed., The Minerals, Metals & Materials Society, 1989, pp. 279-296.

J.F. Barker et al., "Thermomechanical Processing of Inconel 718 and its Effect on Properties," in Advanced High Temperature Alloy: Processing and Properties, ASM, 1989, pp. 125-137.

Azadian et al., "Precipitation in Spray-Formed IN 718," Superalloys 718, 625, 706 and Various Derivatives, The Minerals, Metals & Materials Society, ed. E.A. Loria, 2001, pp. 617-626.

Xie et al., "The Role of Mg on Structure and Mechanical Properties in Alloy 718," Superalloys 1988, The Metallurgical Society, eds. S. Reichman et al., 1988, pp. 635-642.

Andrieu, et al. "Influence of Compositional Modifications on Thermal Stability of Alloy 718," Superalloys 718, 625, 706 and Various Derivatives, ed. E.A. Loria, The Minerals, Metals & Materials Society, 1994, pp. 695-710.

Technical Data Sheet, Allvac® 718 Alloy, Dec. 31, 2001, 2 pages.

"Interrelationships Between Thermomechanical Treatment, Microstructure and Properties of Nickel Base Superalloys," as printed from http://www.ts.mah.se/forskn/mumat/Research_topic_rw.htm. printed on Jul. 17, 2003, 3 pages.

Guo et al., "Further Studies on Thermal Stability of Modified 718 Alloys," Superalloys 718, 625, 706 and Various Derivatives, ed. E.A. Loria, The Minerals, Metals & Materials Society, 1994, pp. 721-734.

Metals Handbook®, Tenth edition, vol. 1, Properties and Selection: Irons, Steels, and High-Performance Alloys, ASM International, 1990, p. 982.

Key to Metals Nonferrous, "Heat Treating of Nickel and Nickel Alloys," printed from http://www.key-to-nonferrous.com/default.aspx?ID=CheckArticle&NM=32 on Mar. 10, 2008, 3 pages.

Mannan et al., "Physical Metallurgy of Alloys 718, 725, 725HS, 925 for Service in Aggressive Corrosive Environments," Special Metals Corporation, Huntington, West Virgina, undated, 12 pages.

Moyer et al., "Advances in Triple Melting Superalloys 718, 706 and 720," Superalloys 718, 625, 706 and Various Derivatives, The Minerals, Metals & Materials Society, 1994. pp. 39-48.

Cordy et al., "Chemistry and Structure Control in Remelted Superalloy Ingots," Proceedings of the 1984 Vacuum Metallurgy Conference on Specialty Metals Melting and Processing, Pittsburgh, Pennsylvania, Jun. 11-13, 1984, pp. 69-74.

Kissinger, Robert D., "Trends and Near Term Requirements of GE Aircraft Engines Titanium and Nickel Base Disk Alloys," Electron Beam Melting and Refining - State of the Art 1991 Conference in Reno, Nevada. Oct. 1992, pp. 31-40.
Choudhury, Alok, "State of the Art Superalloy Production for Aerospace and Other Application Using VIM/VAR or VIM/ESR," ISIJ International, vol. 32, No. 5, 1992, pp. 563-574.
Kennedy et al., "Large Diameter Superalloy Ingots," Advanced Technologies for Superalloy Affordability, ed. Chang et al., The Minerals, Metals & Materials Society, 2000, pp. 159-171.
Schwant, et al. "Large 718 Forgings for Land Based Turbines," Superalloys 718, 625, 706 and Various Derivatives, The Minerals, Metals & Materials Society, ed. E.A. Loria, 1997, pp. 141-152.
Cao et al., "The Effect of Phosphorous on Mechanical Properties of Alloy 718," Superalloys 718, 625, 706 and Various Derivatives, 1994, pp. 463-477.
Kennedy et al., "Stress-rupture Strength of Alloy 718," Advanced Materials & Processes, vol. 149, No. 3, Mar. 1996, pp. 33-35.
Cao et al., "Phosphorous - Boron Interaction in Nickel-Base Superalloys," Superalloys 1996, The Minerals, Metals & Materials Society, 1996, pp. 589-597.
Cao et al., "Effect and Mechanism of Phosphorous and Boron on Creep Deformation of Alloy 718," Superalloys 718, 625, 706 and Various Derivatives, ed. E.A. Loria, 1997, pp. 511-520.
Cao et al., "Production Evaluation of 718-ER® Alloy," Superalloys 2000, The Mineral, Metals & Materials Society, 2000, pp. 101-108.
Xie et al., "The Role of Phosphorous and Sulfur in Inconel 718," Superalloys 1996, The Minerals, Metals and Materials Society, 1996, pp. 599-606.
Xie et al., "Segregation Behavior of Phosphorous and Its Effect on Microstructure and Mechanical Properties in Alloy System Ni-Cr-Fe-Mo-Nb-Ti-Al," Superalloys 718, 625, 706 and Various Derivatives, The Minerals, Metals & Materials Society, ed. E.A. Loria, 1997, pp. 531-542.
Chang et al., "Rene 220: 100° F. Improvement Over Alloy 718," Superalloy 718 - Metallurgy and Applications, The Minerals, Metals & Materials Society, ed. E.A. Loria, 1989, pp. 631-645.
Schafrik et al., "Application of Alloy 718 in GE Aircraft Engines: Past, Present and the Next Five Years," Superalloys 718, 625, 706 and Various Derivatives, 2001, pp. 1-11.
Himushin, F.F., "High-Temperature Strength Metals and Alloys", 2nd Edition, Metallurgy, Moscow, 1969, pp. 442-449, 470-471.
Chen et al. "Strain-induced γ" phase precipitation and γ"→δ transformation in inconel 718 alloy," Metal Journal, Feb. 2000, vol. 36, vol. 2, pp. 150-154.
Andrieu et al. "Effect of Environment and Microstructure on the High Temperature Behavior of Alloy 718," Supperalloy 718 - Metallurgy and Applications, E.A. Loria ed., The Minerals, Metals & Materials Society, 1989, pp. 241-256.
Cozar et al., "Morphology of Y' and Y" Precipitates and Thermal Stability of Inconel 718 Type Alloys," Metallurgical Transactions, vol. 4, Jan. 1973, pp. 47-59.
Collier et al., "The Effect of Varying Al, Ti, and Nb Content on the Phase Stability on INCONEL 718," Metallurgical Transactions A, vol. 19A, Jul. 1988, pp. 1657-1666.
Collier et al., "On Developing a Microstructurally and Thermally Stable Iron-Nickel Base Superalloy," S. Reichman et al. eds., Superalloys 1988, The Metallurgical Society, 1988, pp. 43-52.
Manriquez et al., "The High Temperature Stabiliy of IN718 Derivative Alloys," Superalloys 1992, Antolovich et al. eds., The Minerals, Metals & Materials Society, 1992, pp. 507-516.
Xie et al., "The Role of Phosphorous and Sulfur in INCONEL 718," Superalloys 1996, Kissinger et al. eds., The Minerals, Metals & Materials Society, 1996, pp. 599-606.

* cited by examiner

NICKEL ALLOY AND METHOD INCLUDING DIRECT AGING

CROSS-REFERENCE TO RELATED APPLICATIONS

This application claims priority to U.S. Provisional Application Ser. No. 60/710,806 filed Aug. 24, 2005, which is incorporated in its entirety by reference herein.

STATEMENT REGARDING FEDERALLY SPONSORED RESEARCH OR DEVELOPMENT

Not applicable.

BACKGROUND

Embodiments of the present disclosure relate to nickel-base alloys and methods of direct aging nickel-base alloys. More specifically, certain embodiments of the present disclosure relate to methods of direct aging 718Plus® nickel-base alloy to impart improved mechanical properties, such as, but not limited to, tensile strength, yield strength, low cycle fatigue life, fatigue crack growth, and creep and rupture life to the alloys. Other embodiments of the present disclosure relate to direct aged 718Plus® nickel-base alloy, and articles of manufacture made therefrom, having improved mechanical properties, such as, but not limited to, tensile strength, yield strength, low cycle fatigue life, fatigue crack growth, and creep and rupture life.

The improved performance of the gas turbine engine over the years has been paced by improvements in the elevated temperature mechanical properties of nickel-base superalloys. These alloys are the materials of choice for most of the components of gas turbine engines exposed to the hottest operating temperatures. Components of gas turbine engines such as, for example, disks, blades, fasteners, cases, and shafts are typically fabricated from nickel-base superalloys and are required to sustain high stresses at very high temperatures for extended periods of time.

Alloy 718 is one of the most widely used nickel-base superalloys, and is described generally in U.S. Pat. No. 3,046,108, the specification of which is specifically incorporated by reference herein.

The extensive use of alloy 718 stems from several unique features of the alloy. For example, alloy 718 has high strength and favorable stress-rupture properties up to about 689° C. (1200° F.). Additionally, alloy 718 has favorable processing characteristics, such as castability and hot-workability, as well as good weldability. These favorable characteristics permit the easy fabrication and, when necessary, repair of components made from alloy 718. However, at temperatures higher than 689° C. (1200° F.), mechanical properties of alloy 718 deteriorate rapidly. Therefore the use of alloy 718 has been limited to applications below about 689° C. (1200° F.).

Other superalloys have been developed, for example, René 41® (a registered trademark of ATI Properties, Inc.) and Waspaloy™ nickel-base alloys (a trademark of Pratt & Whitney Aircraft), both of which are available from ATI Allvac of Monroe, N.C., that have increased thermal capabilities relative to alloy 718. These alloys, however, suffer from poor workability and weldability and are more expensive than alloy 718 due, in part, to the incorporation of higher levels of expensive alloying elements.

The nickel-base superalloy 718Plus® (a trademark of ATI Properties, Inc.) is generally described in U.S. Pat. No. 6,730,264, the specification of which is specifically incorporated by reference herein. Alloy 718Plus® comprises, in weight percent, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, and nickel; wherein the sum of the weight percent of molybdenum and the weight percent of tungsten is at least about 2% and not more than about 8%, and wherein the sum of atomic percent aluminum and atomic percent titanium is from about 2% to about 6%, the ratio of atomic percent aluminum to atomic percent titanium is at least about 1.5, and the sum of atomic percent aluminum and atomic percent titanium divided by atomic percent niobium is from about 0.8 to about 1.3. Alloy 718Plus® exhibits improved high temperature mechanical properties compared to alloy 718. In addition, alloy 718Plus® generally has better hot workability and weldability, and is less expensive than René 41® alloy and Waspaloy™ nickel-base alloys.

In co-pending U.S. patent application Ser. No. 10/678,933, the specification of which is specifically incorporated in its entirety by reference herein, the inventors describe nickel-base alloys and methods of processing the same using solution treatment and aging. Alloys processed according to the methods disclosed therein have favorable high temperature mechanical properties, which remain substantially stable when exposed to high temperature.

Nevertheless, it would be advantageous to provide nickel-base alloys having further improved high temperature mechanical properties, while not requiring a solution treatment step during processing. As discussed in detail below, the inventors have identified methods of processing nickel-base alloys which provide enhanced, thermally stabile capabilities without the necessity of a solution treatment step.

BRIEF SUMMARY

The various embodiments of the present disclosure are directed toward methods of direct aging the 718Plus® nickel-base alloy. Improved mechanical properties may be observed in 718Plus® alloy that has been direct aged according to the various non-limiting embodiments disclosed herein.

According to one non-limiting embodiment, there is provided a method of processing a nickel-base alloy comprising: working the nickel-base alloy into a desired shape; and direct aging the nickel-base alloy. The nickel-base alloy according to this non-limiting embodiment comprises, in weight percent, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, nickel, and incidental impurities; wherein the sum of the weight percent of molybdenum and the weight percent of tungsten is at least about 2% and not more than about 8%, and wherein the sum of atomic percent aluminum and atomic percent titanium is from about 2% to about 6%, the ratio of atomic percent aluminum to atomic percent titanium is at least about 1.5, and the sum of atomic percent aluminum and atomic percent titanium divided by atomic percent niobium is from about 0.8 to about 1.3.

Another non-limiting embodiments provides a method of processing a nickel-base alloy having the composition comprising, in weight percent, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, nickel, and incidental impurities; wherein the sum of the weight percent of molybdenum and the weight percent of tungsten is at least about 2% and not more than about 8%, and wherein the sum of atomic percent aluminum and atomic percent titanium is from about 2% to about 6%, the ratio of atomic percent aluminum to atomic percent titanium is at least about 1.5, and the sum of atomic percent aluminum and atomic percent titanium divided by atomic percent niobium is from about 0.8 to about 1.3. The method of processing comprises: working said nickel-base alloy into a desired shape; and direct aging said nickel-base alloy. Direct aging the nickel-base alloy comprises: heating the nickel-base alloy at a first direct aging temperature ranging from 741° C. (1365° F.) to 802° C. (1475° F.) for a time of at least 2 hours; cooling the nickel-base alloy from the first direct aging temperature to a second direct aging temperature ranging from 621° C. (1150° F.) to 718° C. (1325° F.); heating said nickel-base alloy at the second direct aging temperature for a time of at least 8 hours; and cooling said nickel-base alloy from the second direct aging temperature to room temperature.

A further non-limiting embodiment provides a method of forming an article of manufacture comprising: working 718Plus® nickel-base alloy; and direct aging the nickel-base alloy. Direct aging the nickel-base alloy comprises: heating the nickel-base alloy at a first direct aging temperature ranging from 741° C. (1365° F.) to 802° C. (1475° F.) for a time of at least 2 hours; cooling the nickel-base alloy from the first direct aging temperature to a second direct aging temperature ranging from 621° C. (1150° F.) to 718° C. (1325° F.); heating said nickel-base alloy at the second direct aging temperature for a time of at least 8 hours; and cooling said nickel-base alloy from the second direct aging temperature to room temperature.

Yet another non-limiting embodiment provides an article of manufacture made by any of the processes as described directly above or herein below. The article of manufacture may be selected from the group consisting of a turbine or compressor disk, a blade, a shaft, and a fastener.

In still a further non-limiting embodiment, the present disclosure provides a direct aged nickel-base alloy comprising, in weight percent, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, nickel, and incidental impurities; wherein the sum of the weight percent of molybdenum and the weight percent of tungsten is at least about 2% and not more than about 8%, and wherein the sum of atomic percent aluminum and atomic percent titanium is from about 2% to about 6%, the ratio of atomic percent aluminum to atomic percent titanium is at least about 1.5, and the sum of atomic percent aluminum and atomic percent titanium divided by atomic percent niobium is from about 0.8 to about 1.3. The direct aged nickel-base alloy is made by the process comprising: working the nickel-base alloy into a desired shape; and direct aging the nickel-base alloy. According to these embodiments, working the nickel-base alloy comprises: working said nickel-base alloy at a working temperature ranging from 913° C. (1675° F.) to 1066° C. (1950° F.); rapidly cooling said nickel-base from the working temperature to 760° C. (1400° F.) at a cooling rate of about 10° C./min (18° F./min) to about 1667° C./min (3000° F./min); and cooling said nickel-base alloy from 760° C. (1400° F.) to room temperature. Direct aging the nickel-base alloy according to these non-limiting embodiments, comprises: heating the nickel-base alloy at a first direct aging temperature ranging from 741° C. (1365° F.) to 802° C. (1475° F.) for a time of at least 2 hours; cooling the nickel-base alloy from the first direct aging temperature to a second direct aging temperature ranging from 621° C. (1150° F.) to 718° C. (1325° F.); heating said nickel-base alloy at the second direct aging temperature for a time of at least 8 hours; and cooling said nickel-base alloy from the second direct aging temperature to room temperature.

DETAILED DESCRIPTION

Figure 1:
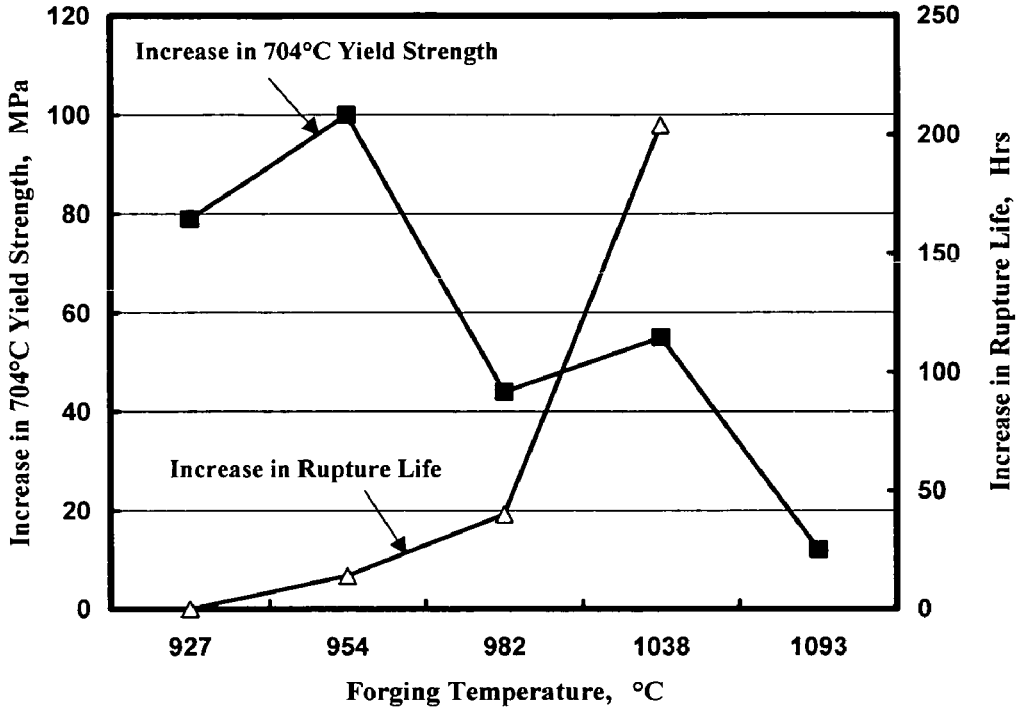
FIG. 1 illustrates the difference in the mechanical properties 704° C. (1300° F.) Yield Strength and Rupture Live from solution treated and aged and direct aged 718Plus® alloy as a function of forging temperature.

Certain non-limiting embodiments of the present disclosure relate to 718-type nickel-base alloys that have been thermomechanically processed by hot, warm, or cold working, and direct aging. As used herein, the term "direct aging" is defined as treating the nickel-base alloy, after working, to an aging process, as described herein, without a prior heat treatment step, such as a solution treatment step. As used herein, the terms "aging" and "aging process" mean heating the nickel-base alloy at a temperature below the solvus temperatures for the γ'-phase (gamma prime phase) and the γ"-phase (gamma double prime phase) to form γ'-phase (gamma prime phase) and γ"-phase (gamma double prime phase) precipitates. As used herein, the terms "solution treatment" and "solution treated" mean treating the alloy to a heat treatment step where the alloy is heated to a temperature and time sufficient to dissolve substantially all of a phase, for example the γ'-phase and γ"-phases precipitates, that exist in the alloy (i.e., a temperature at or above the solvus temperature).

Not all nickel-base superalloys show such superior capabilities when processed by direct aging. For example, due to the fast precipitation kinetics of precipitation hardening γ' particles (gamma prime particles) of the Waspaloy™ alloy, and its poor hot workability at lower hot working temperature, the advantage gained from direct aging of the Waspaloy™ alloy is insignificant.

Certain non-limiting embodiments of the methods of the present disclosure can be advantageous in providing 718Plus® nickel-base alloy having enhanced thermally stable mechanical properties at elevated temperatures when compared to the same nickel-base alloy that has not been treated with the direct aging process of the present disclosure. As used herein, the term "mechanical properties" is defined as properties of the alloy that reveal the elastic and inelastic reaction when force is applied, or that involve the relationship between stress and strain. As used herein, the phrase "thermally stable mechanical properties" means that the mechanical properties of the alloy, such as, for example, tensile strength, yield strength, elongation, fatigue crack growth, low cycle fatigue, and creep and rupture life, are not substantially decreased after exposure to temperatures of about 760° C. (1400° F.) for 100 hours or longer as compared to the same mechanical properties before exposure.

According to certain non-limiting embodiments, the methods of the present disclosure including direct aging to provide 718Plus® nickel-base alloy having enhanced tensile strength at elevated temperatures compared to the same alloy that has not been treated with the direct aging process. In other non-limiting embodiments, the methods of the present disclosure include direct aging to provide 718Plus® nickel-base alloy having enhanced rupture life at elevated temperatures compared to the same alloy that has not been treated with the direct aging process. In addition, the various direct aging methods described herein may result in an improved low cycle fatigue. According to the various non-limiting embodiments, one benefit of the direct aging treatment of the 718Plus® nickel-base alloy is that the treatment may result in (a) fine grain size, such as grain size of ASTM 10 or higher, see Table 2; and (b) high tensile strength. It is believed that improvement in low cycle fatigue results, at least in part, from the improvement in these properties from the direct aging treatment.

Non-limiting embodiments of the present disclosure are directed toward methods of direct aging a nickel-base superalloy, such as, but not limited to, alloy 718Plus® nickel-base superalloy, and compositions and articles of manufacture comprising 718Plus® nickel-base alloys that have been direct aged. As used herein, the terms "nickel-base alloy(s)" and "nickel-base superalloy(s)" mean alloys of nickel and one or more alloying elements. The 718Plus® nickel-based superalloy is generally described in U.S. Pat. No. 6,730,264, the specification of which is specifically incorporated herein by reference, and is available from ATI Allvac, Monroe, N.C. As described therein, alloy 718Plus® comprises, in weight percent, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, nickel, and incidental impurities; wherein the sum of the weight percent of molybdenum and the weight percent of tungsten is at least about 2% and not more than about 8%, and wherein the sum of atomic percent aluminum and atomic percent titanium is from about 2% to about 6%, the ratio of atomic percent aluminum to atomic percent titanium is at least about 1.5, and the sum of atomic percent aluminum and atomic percent titanium divided by atomic percent niobium is from about 0.8 to about 1.3.

Other than in the operating examples, or where otherwise indicated, all numbers expressing quantities of ingredients, processing conditions and the like used in the specification and claims are to be understood as being modified in all instances by the term "about". Accordingly, unless indicated to the contrary, the numerical parameters set forth in the following specification and attached claims are approximations that may vary depending upon the desired properties sought to be obtained. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the disclosure are approximations, the numerical values set forth in the specific examples are reported as precisely as possible. Any numerical values, however, inherently contain certain errors, such as, for example, equipment and/or operator error, necessarily resulting from the standard deviation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

Methods of direct aging 718Plus® nickel-base alloy according to various non-limiting embodiments of the present disclosure will now be described. According to certain non-limiting embodiment of the methods of the present disclosure, 718Plus® nickel-base alloy is worked into a desired shape and then direct aged. According to these embodiments, working of the nickel-base alloy into a desired shape can include hot working, warm working, and cold working or various combinations thereof. In one specific non-limiting embodiment of the present disclosure, working the nickel-base alloy comprises hot working the alloy followed by cold working the alloy. In another non-limiting embodiment of the present disclosure, working the nickel-base alloy comprises cold working the alloy.

As used herein, the term "working" means manipulating and/or altering the shape of the nickel-base alloy by plastic deformation. As used herein, the term "plastic deformation" means permanent distortion of a material under the action of applied stresses. As used herein, the term "hot working" means working the alloy at temperatures sufficiently high such that strain-hardening does not occur. The lower temperature limit for hot working is the re-crystallization temperature of the alloy, which for the alloys of the present disclosure is about 982° C. (1800° F.), however, the re-crystallization temperature may depend on the amount of strain present in the alloy. In certain embodiments of the present disclosure, non-limiting examples of hot working a nickel-base alloy may comprise at least one of forging, hot rolling, extruding, hammering, and swaging. As used herein, the term "cold working" means working the alloy at a temperature sufficiently low to create strain-hardening. As used herein, the term "strain-hardening" means an increase in hardness and strength caused by plastic deformation at temperatures lower than the re-crystallization temperature range. The upper temperature limit for cold working is the re-crystallization temperature of the alloy, which for alloys of the present disclosure is about 982° C. (1800° F.). As used herein, the term "forging" means the process of working the metal alloy to a desired shape by impact or pressure, which may comprise hot working, warm working, cold working, or combinations thereof. The terms "working" and "forging", as used herein, are substantially synonymous. As used herein, the term "forging temperature" means the temperature at which the metal alloy is forged or worked into the desired shape by forging.

According to the various non-limiting embodiments disclosed herein, working the 718Plus® nickel-base alloy comprises heating the alloy to a working or forging temperature ranging from about 913° C. (1675° F.) to about 1066° C. (1950° C.) followed by working or forging the alloy. According to certain non-limiting embodiments, working the 718Plus® nickel-base alloy may comprise heating the alloy at a working or forging temperature ranging from about 913° C. (1675° F.) to about 1038° C. (1900° F.) followed by working or forging the alloy. Working or forging the alloy within this temperature range, followed by direct aging provides an alloy with increased high temperature mechanical properties, such as, for example, increased tensile strength, as discussed below. According to other non-limiting embodiments, working the 718Plus® nickel-base ally may comprise heating the alloy to a working or forging temperature ranging from about 982° C. (1800° F.) to about 1066° C. (1950° C.) followed by working or forging the alloy. Working or forging the alloy within this temperature range, followed by direct aging provides an alloy with increased high temperature rupture life, as discussed below. Further, working of the alloy may comprise repeatedly heating and working the alloy to achieve the desired shape. After working the nickel-base alloy at the working temperature into the desired shape, the nickel-base alloy is rapidly cooled from the working temperature to 760° C. (1400° F.). The alloy is then cooled from 760° C. (1400° F.) to room temperature at any rate.

Direct aging of the 718Plus® nickel-base alloy had the largest effect upon the mechanical properties of the alloy within forging temperatures from about 913° C. (1675° F.) to about 1066° C. (1950° F.). Under these conditions, increases in yield strength and improved stress rupture life are observed compared to solution treated and aged alloy forged under the same forging process. However, forging temperature dependencies of tensile strength and of rupture life are different under direct aging conditions. Compared to solution treated and aged alloy forged within the same temperature range, the greatest increases in yield strength (at 704° C. (1300° F.)) results from forging at temperatures within the range of about 913° C. (1675° F.) to about 1038° C. (1900° F.). On the other hand, the greatest increases in rupture life (at 704° C. (1300° F.)), over solution treated and aged levels, results from forging at temperatures within the range of about 982° C. (1800° F.) to about 1066° C. (1950° C.). One skilled in the art will also recognize that increases in rupture life also result in increases in high temperature creep. Thus, according to the various non-limiting embodiments where increased rupture life is obtained, as described herein, increases in high temperature creep may also be observed.

Figure 2:
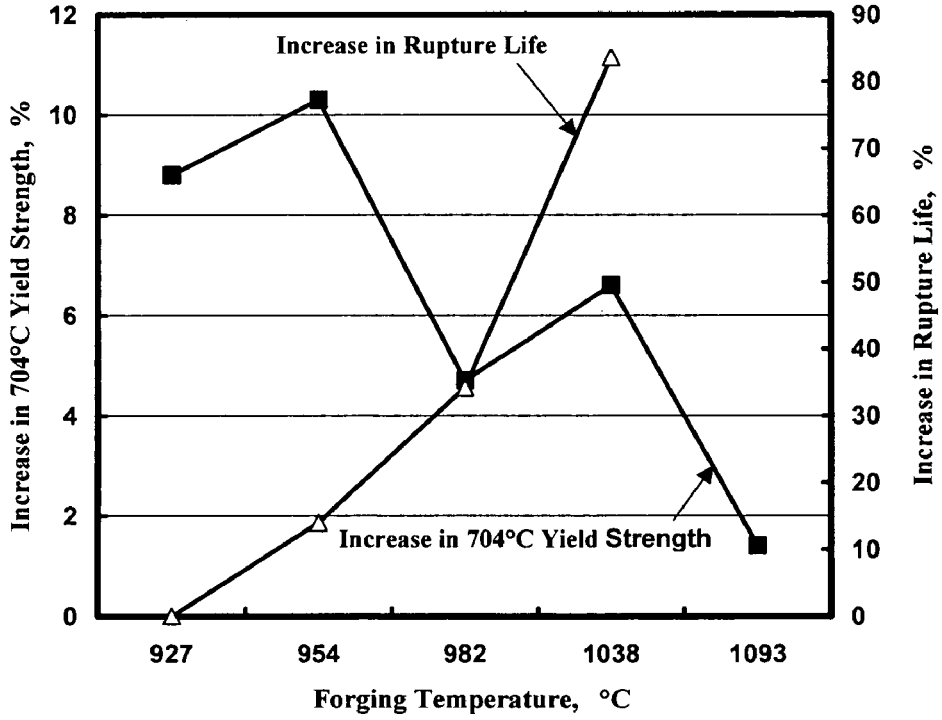
FIG. 2 illustrates the percentage change in the mechanical properties from solution treated and aged and direct aged 718Plus® alloy as a function of forging temperature.

FIG. 1 illustrates the response to direct aging processing of the 718Plus® alloy, as a function of forging temperature, as the increase in direct aging values over solution aging values for yield strength (YS) and rupture life. FIG. 1 shows that 704° C. (1300° F.) rupture life increase (i.e., $\text{life}_{direct\ age}-\text{life}_{solution\ age}$) increases with increased forging temperature (i.e., between about 982° C. (1800° F.) to about 1066° C. (1950° C.)), whereas 704° C. (1300° F.) YS increase (i.e., $\text{YS}_{direct\ age}-\text{YS}_{solution\ age}$) increases with decreased forging temperature (i.e., between about 913° C. (1675° F.) to about 1038° C. (1900° F.)). FIG. 2 illustrates direct aging response to forging temperatures of alloy 718Plus® as relative improvement (percentage) in properties compared to solution aging. Thus, direct aging conditions may be tailored for alloy 718Plus® to optimize a particular set of properties, depending on the specific final part requirements. For example, forging at higher temperature ranges, such as, from about 982° C. (1800° F.) to about 1066° C. (1950° F.) followed by direct aging provides a material with tensile strengths slightly higher than those obtained by solution treatment and aging processing but with significantly improved rupture lives compared to solution treatment and aging. Alternatively, forging at temperature ranges between about 913° C. (1675° F.) to about 1038° C. (1900° F.), which may include additional room temperature cold working, greatly increases tensile strength when compared to solution treatment and aging, with little or no increase in rupture life compared to solution treatment and aging.

According to certain non-limiting embodiments disclosed herein where increased yield strengths are obtained (i.e., with forging temperatures raging from about 913° C. (1675° F.) to about 1038° C. (1900° F.), during the working process, the temperature of the alloy must decrease to below the hot working temperature so that some residual dislocation substructure is retained. In any case, the alloy may be re-heated to the working temperature before each subsequent working step or pass. For example, in certain non-limiting embodiments, the 718Plus® nickel-base alloy is repeatedly heated to the working temperature and worked and, prior to the final working pass, the alloy is re-heated at a temperature ranging from about 913° C. (1675° F.) to about 1066° C. (1950° F.). According to certain non-limiting embodiments, the nickel-base alloy is repeatedly heated and worked and, prior to the final working pass, the alloy is re-heated at a temperature ranging from about 913° C. (1675° F.) to about 1038° C. (1900° F.). In other non-limiting embodiments, the nickel-base alloy is repeatedly heated and worked and, prior to the final working pass, the alloy is re-heated at a temperature ranging from about 982° C. (1800° F.) to about 1066° C. (1950° F.). According to certain non-limiting embodiments, the re-heating the alloy to a temperature prior to a final working pass, as set forth above, may be for any amount of time sufficient to observe the increased material properties as discussed herein. According to certain non-limiting embodiments, re-heating the alloy prior to a final working pass may be for a time less than five hours. As used herein, the term "final working pass" means the last working step prior to rapidly cooling the nickel-base alloy to about 760° C. (1400° F.).

The rapid cooling of the 718Plus® nickel-base alloy during hot working in certain embodiments of the present disclosure will now be discussed in detail. The cooling rate after the final working pass may affect the effectiveness of the direct aging treatment and slow cooling should be avoided, especially within the temperature range for the γ' (gamma prime) solvus temperature (about 982° C. (1800° F.)) to about 760° C. (1400° F.). Without meaning to be bound by any particular theory, it is believed that rapid cooling is necessary to prevent the precipitation of coarse γ' (gamma prime) precipitates, which may occur when the alloy is slowly cooled within this temperature range. Therefore, according to certain non-limiting embodiments, the 718Plus® nickel-base alloy is rapidly cooled after the final working pass of the alloy at the working temperature, for example, a temperature ranging from about 913° C. (1675° F.) to about 1066° C. (1950° F.). The nickel-base alloy is rapidly cooled from the working temperature to a temperature of about 760° C. (1400° F.). The cooling rate of the nickel-base alloy may depend, in part, on the size and/or thickness of the article being rapidly cooled and may range from 10° C./min (18° F./min) up to 1667° C./min (3000° F./min). In one non-limiting embodiment of the present disclosure, the alloy is rapidly cooled at a cooling rate of greater than 28° C./min (50° F./minute). In another non-limiting embodiment, the alloy is rapidly cooled at a cooling rate of greater than 42° C./min (75° F./min). According to certain non-limiting embodiments, the alloy can be rapidly cooled at a rate of 28° C./min (50° F./min) to 112° C./min (200° F./min). In other non-limiting embodiments the alloy is rapidly cooled at a cooling rate of 42° C./min (75° F./min) to 112° C./min (200° F./min). Non-limiting methods of rapidly cooling the worked nickel-base alloy include, for example, air cooling, forced air cooling and oil or water quenching. Once the nickel-base alloy has been rapidly cooled to about 760° C. (1400° F.), the alloy may be further cooled to room temperature. The rate of cooling from about 760° C. (1400° F.) to room temperature may be at any rate that is commercially acceptable, and may be either rapid or slow.

In specific non-limiting embodiments of the methods of the present disclosure, the degree of plastic deformation during working of the alloy may be a factor in the success of the direct aging treatment. There may be insubstantial effect on mechanical properties of the alloy by direct aging if the plastic deformation is too small. In certain non-limiting embodiments comprising working the nickel-base alloy, deformation greater than 10% can improve the mechanical properties of the nickel-base alloy, as compared to worked nickel-base alloy with deformation less than 10%. It is anticipated that the effect of direct aging will gradually diminish as the deformation is decreased from 10% to 0%. In another non-limiting embodiment of the present disclosure, the worked nickel-base alloy comprises deformation from about 12% to about 67%. However, a too high degree of plastic deformation during one working pass may reduce the improved mechanical properties resulting from the direct aging treatment. Without meaning to be bound by any particular theory, it is believed that this is due to significant adiabatic heating, which occurs at the high working strain rates employed. Large working reductions can be used if strain rates can be lowered to avoid excessive adiabatic heating.

In certain non-limiting embodiments of the present disclosure, working the 718Plus® nickel-base alloy comprises cold working before the direct aging step. In certain embodiments the nickel-base alloy is cold worked at a temperature less than 982° C. (1800° F.). According to other non-limiting embodiments, the nickel-base alloy is cold worked at about room temperature. Cold working, in general, refers to plastic working of the alloy without recovery and recrystallization of the alloy. Cold working the nickel-base alloy into the desired shape may include any commercially accepted method of cold working, including, but not limited to, cold rolling, cold drawing, hammering, swaging, and various combinations of these cold working methods. As shown below, hot working followed by the combination of cold working and direct aging can increase the strength, such as, the 704° C. (1300° F.) tensile strength, of the 718Plus® alloy. As used herein, the term "704° C. (1300° F.) tensile strength" is defined as a measurement of the strength, in units of megapascals (MPa) or kilopounds/inch$^2$ (ksi), of the alloy when heated to 704° C. (1300° F.) according to ASTM E21, the disclosure of which is incorporated herein by reference. According to certain non-limiting embodiments, cold working, such as, for example, cold working at room temperature followed by direct aging under the processes disclosed herein may result in an alloy with a 704° C. (1300° F.) tensile yield strength compared to a similar alloy that is not cold worked at room temperature and direct aged, for example an alloy that is solution treated and aged.

As previously discussed, according to various non-limiting embodiments disclosed herein, the 718Plus® nickel-base alloy is direct aged after the alloy has been worked into the desired shape. Although not limiting herein, according to certain non-limiting embodiments, direct aging the nickel-base alloy may comprise: heating the worked nickel-base alloy to a first direct aging temperature ranging from about 741° C. (1365° F.) to about 802° C. (1475° F.) for a time of at least about 2 hours (time at temperature). According to other non-limiting embodiments, direct aging the nickel-base alloy may comprise: heating the worked nickel-base alloy to a first direct aging temperature ranging from about 741° C. (1365° F.) to about 802° C. (1475° F.) for a time ranging from about 2 hours to about 8 hours, cooling the nickel-base alloy from the first direct aging temperature to a second direct aging temperature ranging from about 621° C. (1150° F.) to about 718° C. (1325° F.), maintaining or heating the alloy at the second direct aging temperature for a time of at least 8 hours, and cooling the nickel-base alloy to room temperature. According to other non-limiting embodiments, the second direct aging temperature may be from about 635° C. (1175° F.) to about 718° C. (1325° F.). In certain embodiments disclosed herein, cooling the nickel-base alloy from the first direct aging temperature to the second direct aging temperature may comprise furnace cooling the nickel-base alloy from the first direct aging temperature to the second direct aging temperature. As used herein, the term "furnace cooling" means allowing the nickel-based alloy to cool in the furnace while the furnace cools to the desired temperature or after the power to the furnace has been turned off. According to other non-limiting embodiments, the nickel-base alloy may be cooled, for example, by furnace cooling or air cooling, from the first direct aging temperature to a lower temperature, such as room temperature, and then reheated to the second direct aging temperature.

According to various embodiments of the present disclosure, when it is desired to slowly cool the 718Plus® nickel-base alloy during direct aging from the first direct aging temperature to the second direct aging temperature the alloy may be cooled at any rate. According the certain embodiments, alloy may be cooled at a cooling rate of 44° C./hr (80° F./hour) to 67° C./hr (120° F./hour). In other non-limiting embodiments, the alloy is cooled at a cooling rate of about 56° C./hr (100° F./hour). The nickel-base alloy is maintained at the second direct aging temperature for a time of at least 8 hours and may then be cooled to room temperature using any acceptable means in the art, including, for example, air cooling.

Direct aged 718Plus® nickel-base alloy according to the various embodiments of the present disclosure can have enhanced mechanical properties, as compared to analogous nickel-base alloys that are treated under non-direct aging conditions, for example, under solution aging conditions. According to certain non-limiting embodiments, direct aging of 718Plus® alloy that has been forged at a temperature of about 913° (1675° F.) to about 1038° C. (1900° F.) has a 704° C. (1300° F.) yield tensile strength of about 40 MPa to about 100 MPa greater than the 704° C. (1300° F.) yield tensile strength of solution treated and aged 718Plus® alloy that has been forged at the same temperature. This increase corresponds to a 4% to 11% increase in 704° C. (1300° F.) yield tensile strength for direct aged 718Plus® alloy over solution treated and aged 718Plus® alloy forged at the same temperature. As shown in FIGS. 1 and 2. According to other non-limiting embodiments, direct aging of 718Plus® alloy that has been forged at a temperature of about 982° C. (1800° F.) to about 1066° C. (1950° C.) has a stress rupture life at 704° C. (1300° F.) and 552 MPa of from about 40 hours to about 200 hours greater than the stress rupture life of solution treated and aged 718Plus® alloy that has been forged at the same temperature. This increase corresponds to a 34% to 83% increase in stress rupture life for direct aged 718Plus® alloy over solution treated and aged 718Plus® alloy forged at the same temperature. As shown in FIGS. 1 and 2.

The improved mechanical properties of the direct aged 718Plus® alloy, under the various non-limiting embodiments disclosed herein, are thermally stable. The improved mechanical properties of the alloys treated by the various non-limiting methods of the present disclosure are observed even after exposure to elevated temperatures of about 760° C. (1400° F.) for extended periods of time (100 hours or longer).

The 718Plus® nickel-base alloys according to the various embodiments of the present disclosure may be a wrought 718Plus® nickel-base alloy. For example, although not limiting herein, the nickel-base alloy can be manufactured by melting raw materials having the desired composition in a vacuum induction melting ("VIM") operation, and subsequently casting the molten material into an ingot. Thereafter, the cast material may be further refined by remelting the ingot. For example, the cast material can be remelted via vacuum arc remelting ("VAR"), electro-slag remelting ("ESR"), or a combination of ESR and VAR, all of which are known in the art. Alternatively, other methods known in the art for melting and remelting can be utilized.

Embodiments of the present disclosure further contemplate articles of manufacture made using the 718Plus® nickel-base alloy and methods of direct aging the 718Plus® nickel-base alloy of the present disclosure. Non-limiting examples of articles of manufacture that can be made using the 718Plus® nickel-base alloy and methods of direct aging the 718Plus® nickel-base alloy according to the various non-limiting embodiments of the present disclosure include, but are not limited to, turbine and compressor parts, such as, disks, blades, shafts, and fasteners.

Various non-limiting embodiments of the present disclosure will now be illustrated in the following non-limiting examples.

EXAMPLES

Example 1

In a first example, the mechanical properties of 718Plus® alloy, that was solution treated and aged according to the disclosure of U.S. patent application Ser. No. 10/678,933, were compared to the mechanical properties of 718Plus® alloy that was directly aged according to one non-limiting embodiment of the present disclosure. The mechanical properties from three processing conditions were examined, resulting in products with ASTM grain size varying from 12 to 7. The results are presented in Table 1—Comparison of Mechanical Properties Between Solution-Aged and Direct Aged 718Plus® Alloy Products Made by Different Processing Conditions.

The 718Plus® alloy samples for this Example were prepared as follows. The solution treated and aged alloy samples were solution treated by heating at 954° C. (1750° F.) for 1 hour followed by air cooling. The samples were then aged at 788° C. (1450° F.) for 2 hours, furnace cooled at a rate of 55° C./hr (100° F./hr) from 788° C. (1450° F.) to a temperature of 650° C. (1200° F.), aged at 650° C. (1200° F.) for 8 hours, and then air cooled to room temperature. The direct aged products were direct aged according to one non-limiting embodiment of the present disclosure. The direct aged products were heated at 788° C. (1450° F.) for 2 hours, furnace cooled at a rate of 55° C./hr (100° F./hr) from 788° C. (1450° F.) to a temperature of 650° C. (1200° F.), aged at 650° C. (1200° F.) for 8 hours, and then air cooled to room temperature.

The products were subjected to tensile testing at 704° C. (1300° F.) according to ASTM E21, the disclosure of which is incorporated herein by reference, and the tensile strength ("UTS"), yield strength ("YS"), percent elongation ("EL"), and percent reduction in area ("RA") for each product were determined. In addition, the products were subjected to stress-rupture life testing at 704° C. (1300° F.) and 552 MPa (80 ksi) according to ASTM 292, the disclosure of which is incorporated herein by reference, and the stress-rupture life and percent elongation at rupture for each product were determined.

Both the tensile strength and stress-rupture life of alloy 718Plus® were significantly improved by direct aging as compared to tensile strength and stress-rupture life of the solution treated and aged 718Plus® alloy, but the improvements depend, in part, on the hot working conditions. The increase in both strength and stress-rupture properties was significant in small size bar rolled at a finishing temperature of 905° C. (1662° F.) (surface). The direct aged product had a YS of 1072 MPa (155.5 ksi) and a stress-rupture life of 261.3 hours compared to a YS of 904 MPa (131.2 ksi) and a stress-rupture life of 100.0 hours for the solution treated and aged product. The improvements, particularly in strength, diminished with increasing starting working temperature and product size, which can directly affect the finishing working temperature.

TABLE 1

Comparison of Mechanical Properties for Solution Treated and Aged (SA) and Direct-Aged (DA) Alloy 718Plus ® Mill Products

| | ASTM | | | 704° C. Tensile | | | | Stress Rupture at 704° C./552 MPa | |
|---|---|---|---|---|---|---|---|---|---|
| Processing | Grain Size | HT* | Thermal Exposure | UTS MPa | YS MPa | EL % | RA % | Life Hrs. | EL % |
| 19 mm ϕ rolled Bar start at 1038° C. finish at 905° C. (surface) | 12 | SA | None | 1110 | 904 | 22.5 | 26.4 | 100 | 44.5 |
| | | | 760° C. × 100 hrs | 1067 | 873 | 37.8 | 47.3 | 87 | 41.4 |
| | | DA | None | 1220 | 1072 | 15.1 | 16.4 | 261 | 40.4 |
| | | | 760° C. × 100 hrs | 1242 | 1098 | 13.2 | 12.2 | 386 | 26.6 |
| 200 mm ϕ forged Billet with starting forging temp. at 1010° C. | 8 | SA | None | 1118 | 899 | 16.2 | 16.8 | 356 | 42.6 |
| | | DA | None | 1108 | 958 | 35.9 | 59.8 | 515 | 42.5 |

TABLE 1-continued

Comparison of Mechanical Properties for Solution Treated and Aged (SA) and Direct-Aged (DA) Alloy 718Plus ® Mill Products

| Processing | ASTM Grain Size | HT* | Thermal Exposure | 704° C. Tensile UTS MPa | YS MPa | EL % | RA % | Stress Rupture at 704° C./552 MPa Life Hrs. | EL % |
|---|---|---|---|---|---|---|---|---|---|
| 254 mm ϕ forged Billet with starting forging temp. at 1010° C. | 7 | SA | None | 1132 | 938 | 17.1 | 22.7 | 360 | 36.5 |
| | | DA | None | 1089 | 900 | 33.4 | 52.7 | 500 | 35.5 |

*Heat Treatment:
SA: Solution (954° C. × 1 hr., AC) + Aging (788° C. × 2 hrs., 55° C./hr cool to 650° C., 650° C. × 8 hrs, AC)
DA: Direct Aging (788° C. × 2 hrs, 55° C./hr cool to 650° C., 650° C. × 8 hrs, AC)

Example 2

This Example was designed to determine satisfactory working conditions for various non-limiting embodiments of the methods of the present disclosure. In this example, two sets of four 5.08 cm by 5.08 cm by 5.08 cm cubes were cut from a 25.4 cm diameter round billet of 718Plus® nickel-base alloy. The cubes were heated to a series of different temperatures between 927° C. (1700° F.) and 1093° C. (2000° F.). All cubes were then worked as follows. The cubes were first reduced to a thickness of 3.81 cm in a first pass and further reduced, in a second pass, to a thickness of 2.54 cm after re-heating to the indicated working temperatures. The 2.54 cm thick flattened cubes (or "pancakes") were re-heated at a finishing forging temperature, ranging from 1093° C. (2000° F.) to 927° C. (1700° F.) (as indicated in Table 2) for about 0.5 hours and further reduced, in a final working pass, down to 1.27 cm thick pancakes (50% reduction in the final working pass). The resulting pancakes had a uniform grain structure without noticeable chilling effect from forging dies. The forged pancakes were air cooled to room temperature after final forging and test sample blanks were cut from the forged pancakes. One set of four test blanks were solution treated according to the solution aging procedure set forth in Example 1, the other set of four test blanks were direct aged according to one non-limiting embodiment of present disclosure as described in Example 1.

Tensile tests at 704° C. (1300° F.), and stress-rupture tests at 704° C. (1300° F.) and 552 MPa (80 ksi) were performed. The results of the effect of forging temperature are presented in Table 2—Effect of Working Temperature on Efficiency of Direct Aging.

The results in Table 2 indicate that working temperature can affect the mechanical properties observed after direct aging the 718Plus® alloy. Direct aging after working at 927° C. (1700° F.) gave improved 704° C. (1300° F.) tensile properties as those observed with solution treated and aged alloys that were worked at the same temperature, but rupture life was essentially unchanged. When the alloy was direct aged after working at working temperatures from about 954° C. (1750° F.) to about 982° C. (1800° F.), 704° C. (1300° F.) tensile strength increased significantly but only modest increases in stress-rupture properties were observed. Hot working and direct aging the alloy from 1038° C. (1900° F.) resulted in a modest increase in YS but stress rupture life nearly doubled. When a still higher working temperature of 1093° C. (2000° F.) was employed, the direct aged alloy had a stress-rupture life of less than 1 hour and the tested sample displayed a notch stress rupture break (N.B.).

TABLE 2

Effect of Forging Temperature on Effectiveness of Direct Aging Alloy 718Plus ®

| Finishing Forging | ASTM Grain Size | HT* | 704° C. Tensile UTS MPa | YS MPa | EL % | RA % | Stress Rupture 704° C./552 MPa Life hrs | EL % |
|---|---|---|---|---|---|---|---|---|
| 1093° C. × 30 min, | 5 | SA | 1158 | 838 | 21.1 | 28.6 | 346 | 39.5 |
| 50% Reduction | | DA | 1056 | 850 | 10.7 | 13.5 | 0.6 | N.B. |
| 1038° C. × 30 min, | 6 | SA | 1093 | 824 | 19.1 | 19.0 | 244 | 49.0 |
| 50% Reduction | | DA | 1100 | 879 | 12.0 | 16.7 | 447 | 31.8 |
| 982° C. × 30 min, | 10 | SA | 1123 | 929 | 21.7 | 26.6 | 117 | 34.1 |
| 50% Reduction | | DA | 1172 | 973 | 16.4 | 40.9 | 157 | 36.2 |
| 954° C. × 30 min, | 12 | SA | 1118 | 973 | 27.5 | 36.0 | 109 | 36.2 |
| 50% Reduction | | DA | 1205 | 1072 | 29.9 | 35.1 | 123 | 41.9 |
| 927° C. × 30 min, | Finer than | SA | 1144 | 996 | 22.5 | 31.0 | 72 | 43.4 |
| 50% Reduction | ASTM 12 | DA | 1203 | 1075 | 16.5 | 21.0 | 69 | 35.1 |

*Heat Treatment:
SA - Solution (954° C. × 1 hr, AC) + Aging (788° C. × 2 hrs, 55° C./hr cool to 650° C., 650° C. × 8 hrs, AC)
DA - Direct Aging (788° C. × 2 hrs, 55° C./hr cool to 650° C., 650° C. × 8 hrs, AC)

Example 3

This Example was designed to determine the effect of heating time at hot working temperatures on mechanical properties of 718Plus® nickel-base alloy. This was examined due to the fact that the heating time in certain commercial practices may be quite long, especially for heavy, large cross section pieces. Samples of the 718Plus® nickel-base alloy were heated at forging temperatures of 927° C. (1700° F.) or 954° C. (1750° F.) for 0.5 hours or 3 hours. One half of the samples were then solution treated and aged according to the process set forth in Example 1. The other half of the samples were direct aged according to one non-limiting embodiment of the present disclosure as described in Example 1.

Tensile tests at 704° C. (1300° F.), and stress-rupture tests at 704° C. (1300° F.) and 552 MPa (80 ksi) were performed. The results of the effect of forging temperature are presented in Table 3—Effect of Heating Time at Forging Temperature on Efficiency of Direct Aging.

The results displayed in Table 3 show that the high temperature mechanical properties of the alloy decreased as a result of extended heating times at forging temperature, however, the reduction was modest in most cases. For example, the 704° C. (1300° F.) tensile strength (YS) of direct aged alloy samples for a forging temperature of 954° C. (1750° F.) was 1072 MPa (155.5 ksi) when the forging time was 0.5 hours and decreased to 1047 MPa (151.9 ksi) when the forging time was 3 hours. The 704° C. (1300° F.) tensile strength (YS) of direct aged alloy samples for a forging temperature of 927° C. (1700° F.) was 1072 MPa (155.5 ksi) when the forging time was 0.5 hours and decreased to 1047 MPa (151.9 ksi) when the forging time was 3 hours.

Example 4

This Example was designed to determine the effect of the amount or degree of plastic deformation of alloy samples on the tensile strength and stress-rupture life of the direct aged alloy. The degree of plastic deformation during working can be a factor in the success of the direct aging treatment. In the present Example, plastic deformation in the form of forging reduction in pancake forging was examined for 718Plus® nickel-base alloy. Final forging reductions ranging from 12% to 67% were examined at working temperatures of 954° C. (1750° F.) and 982° C. (1800° F.). After finishing forging, the alloy samples were direct aged according to one non-limiting embodiment of the present disclosure as set forth in Example 1.

Tensile strength tests at 704° C. (1300° F.) were performed and the stress-rupture life of the alloy samples was tested at 704° C. (1300° F.) and 552 MPa (80 ksi). The effect of forging reduction on the mechanical properties of the direct aged alloy samples are presented in Table 4—Effect of Forging Reduction on Efficiency of Direct Aging.

Table 4 shows that the improvements in 704° C. (1300° F.) tensile strengths that result from the direct aging process of the 718Plus® alloy samples are present for forging reductions ranging from as low as 12-20% up to 67%. While there are some differences in property levels as a function of the finish forge reduction, in all cases, the 704° C. (1300° F.) YS and 704° C. (1300° F.) and 552 MPa (80 ksi) stress rupture lives, over the entire range investigated, exceeded the values for the solution treated and aged material properties for the same forging temperatures presented in Table 2.

TABLE 3

Effect of Forging Heating Time on Effectiveness of Direct Aging

| Finishing | | | 704° C. Tensile | | | | Stress Rupture 704° C./554 MPa | |
|---|---|---|---|---|---|---|---|---|
| Forging Temperature | Heating Time | HT* | UTS MPa | YS MPa | EL % | RA % | Life hrs | EL % |
| 954° C. | 0.5 hrs | SA | 1118 | 973 | 27.5 | 36.0 | 109 | 36.2 |
| 50% | | DA | 1205 | 1072 | 29.9 | 35.1 | 123 | 41.9 |
| Reduction | 3 hrs | SA | 1130 | 950 | 18.3 | 23.8 | 71 | 43.4 |
| | | DA | 1174 | 1047 | 36.2 | 70.0 | 55 | 39.9 |
| 927° C. | 0.5 hrs | SA | 1144 | 996 | 22.5 | 31.0 | 72 | 43.4 |
| 50% | | DA | 1205 | 1072 | 16.5 | 21.0 | 69 | 35.1 |
| Reduction | 3 hrs | SA | 1126 | 1002 | 28.9 | 58.0 | 65 | 36.2 |
| | | DA | 1162 | 1047 | 26.7 | 60.0 | 60 | 29.2 |

*Heat Treatment:

SA - Solution (954° C. × 1 hr, AC) + Aging (788° C. × 2 hrs, 55° C./hr cool to 650° C., 650° C. × 8 hrs, AC)

DA - Direct Aging (788° C. × 2 hrs, 55° C./hr cool to 650° C., 650 CF × 8 hrs, AC)

TABLE 4

Effect of Forging Reduction on Effectiveness of Direct Aging Alloy 718Plus ®

| Finishing Forging | Finish Forge Reduction | HT* | R.T. Tensile UTS MPa | R.T. Tensile YS MPa | R.T. Tensile EL % | R.T. Tensile RA % | 704° C. Tensile UTS MPa | 704° C. Tensile YS MPa | 704° C. Tensile EL % | 704° C. Tensile RA % | Stress Rupture 704° C./552 MPa Life hrs | Stress Rupture 704° C./552 MPa EL % |
|---|---|---|---|---|---|---|---|---|---|---|---|---|
| 982° C. × 30 min. | 20% | DA | 1607 | 1299 | 18.2 | 23.7 | 1227 | 1102 | 24.5 | 54.1 | 166 | 34.4 |
| | 50% | DA | 1576 | 1257 | 20.3 | 25.7 | 1172 | 973 | 16.4 | 40.9 | 157 | 36.2 |
| | 67% | DA | 1539 | 1184 | 22.5 | 34.5 | 1164 | 943 | 17.6 | 20.2 | 178 | 53.4 |
| 954° C. × 30 min. | 12% | DA | 1540 | 1223 | 21.6 | 26.1 | 1184 | 1036 | 17.5 | 16.8 | 245 | 31.4 |
| | 50% | DA | 1600 | 1310 | 19.6 | 21.6 | 1205 | 1072 | 29.9 | 35.1 | 123 | 41.9 |
| | 67% | DA | 1572 | 1246 | 22.1 | 27.3 | 1191 | 1013 | 19.0 | 20.3 | 141 | 34.0 |

*Heat Treatment: DA - Direct Aging (788° C. × 2 hrs, 55° C./hr cool to 650° C., 650° C. × 8 hrs, AC)

Example 5

The effect of the cooling rate after working on the mechanical properties of direct aged 718Plus® nickel-base alloy was examined in this Example. The cooling rate after working may have an effect on the observed mechanical properties of the direct aged alloy. Slow cooling, especially within the temperature range from γ' (gamma prime) solvus temperature (about 982° C. (1800° F.)) to about 760° C. (1400° F.) reduces the observed improvements in the mechanical properties resulting from direct aging. This may be due to the precipitation of coarse γ' (gamma prime) particles during slow cooling through such a temperature range. In this Example, the effect of cooling rate after working during a pancake forging trial (as described in Example 2) using 718Plus® nickel-base alloy was examined. After working at 982° C. (1800° F.) with 50% reduction or 954° C. (1750° F.) with 50% reduction, the pancake alloy samples were cooled from the working temperature to 760° C. (1400° F.) at a cooling rate of either 112° C./min (200° F./min) or 42° C./min (75° F./min). Cooling at these rates (i.e., 112° C./min (200° F./min) and 42° C./min (75° F./min)) may be achieved in commercial production, even for large articles of manufacture, by various methods known in the art, such as forced air cooling or oil or water quenching. The alloy samples were then cooled to room temperature and direct aged according to one non-limiting embodiment of the present disclosure as set forth in Example 1.

Tensile strength tests at 704° C. (1300° F.) were performed and the stress-rupture life of the alloy samples was tested at 704° C. (1300° F.) and 552 MPa (80 ksi). The effect of the cooling rate after working on the mechanical properties of the direct aged alloy samples are presented in Table 5—Effect of Cooling Rate after Forging on Efficiency of Direct Aging.

Table 5 shows that the improved mechanical properties from direct aging of the nickel-base alloy can be dependent on the cooling rate of the alloy from the working temperature down to 760° C. (1400° F.). Reduction of the average cooling rate from the working temperature to 760° C. (1400° F.) from 112° C./min (200° F./min) to 42° C./min (75° F./min) shows only slight reduction in the improvements in the mechanical properties of the direct aged nickel-base alloys. This Example also shows that the significant improvement in tensile strength for the direct aged 718Plus® products over solution treated and aged products, presented in Table 2, are maintained with cooling rates as low as 42° C./min (75° F./min). For example, at a working temperature of 982° C. (1800° F.), a cooling rate of 112° C./min (200° F./min) resulted in an alloy sample with a 704° C. (1300° F.) YS of 973 MPa (141.2 ksi) and a stress-rupture life of 157.3 hours, whereas a cooling rate of 42° C./min (75° F./min) resulted in an alloy sample with a 704° C. (1300° F.) YS of 980 MPa (142.2 ksi) and a stress-rupture life of 146.1 hours. At a working temperature of 954° C. (1750° F.), a cooling rate of 112° C./min (200° F./min) resulted in an alloy sample with a 704° C. (1300° F.) YS of 1072 MPa (155.5 ksi) and a stress-rupture life of 122.9 hours, whereas a cooling rate of 42° C./min (75° F./min) resulted in an alloy sample with a 704° C. (1300° F.) YS of 1007 MPa (146.1 ksi) and a stress-rupture life of 98.6 hours.

TABLE 5

Effect of Post-Forging Cooling Rate on Effectiveness of Direct Aging Alloy 718Plus ®

| Finishing Forging | Cooling Rate* ° C./min | HT** | Room Temperature Tensile UTS MPa | Room Temperature Tensile YS MPa | Room Temperature Tensile EL % | Room Temperature Tensile RA % | 704° C. Tensile UTS MPa | 704° C. Tensile YS MPa | 704° C. Tensile EL % | 704° C. Tensile RA % | Stress Rupture 704° C./552 MPa Life hrs | Stress Rupture 704° C./552 MPa EL % |
|---|---|---|---|---|---|---|---|---|---|---|---|---|
| 982° C. × 30 min, | 112 | DA | 1576 | 1257 | 20.3 | 25.7 | 1172 | 973 | 16.4 | 40.9 | 157 | 36.2 |
| 50% Reduction | 42 | DA | 1552 | 1217 | 21.2 | 32.0 | 1168 | 980 | 22.4 | 29.4 | 146 | 45.7 |
| 954° C. × 30 min, | 112 | DA | 1600 | 1310 | 19.6 | 21.6 | 1205 | 1072 | 29.9 | 35.1 | 123 | 41.9 |
| 50% Reduction | 42 | DA | 1598 | 1298 | 19.0 | 25.8 | 1175 | 1007 | 23.0 | 39.0 | 99 | 42.5 |

*Cooling rate was the average rate from forging temperature to 760° C.

**Heat Treatment: DA - Direct Aging (788° C. × 2 hrs, 55° C./hr cool to 650° C., 650° C. × 8 hrs, AC)

Example 6

This Example was designed to assess whether the improved mechanical properties that result from direct aging the 718Plus® nickel-base alloy diminish after extended thermal exposure. In this Example, samples of 718Plus® nickel-base alloy were either solution treated and aged or direct aged as described below and then thermally exposed to 760° C. (1400° F.) for 100 hours. The high temperature mechanical properties of the thermally exposed 718Plus® alloy samples were compared to the high temperature mechanical properties of non-thermally exposed 718Plus® alloy samples. Small sized nickel-base alloy rolled bars, as described in Table 1, were treated as follows. One half of the bars were solution treated at 954° C. (1750° F.) for 1 hour and then air cooled. All of the samples, both solution treated and direct aged, were then aged by one of the following aging procedures: (1) the alloy sample was aged at a temperature of 741° C. (1365° F.) for 8 hours, furnace cooled at 55° C./hr (100° F./hr) to 621° C. (1150° F.), heated at 621° C. (1150° F.) for 8 hours and then air cooled to room temperature, or (2) the alloy sample was aged at a temperature of 788° C. (1450° F.) for 2 hours, furnace cooled at 55° C./hr (100° F./hr) to 649° C. (1200° F.), heated at 649° C. (1200° F.) for 8 hours and then air cooled to room temperature.

Tensile tests at 704° C. (1300° F.) were performed and the stress-rupture life of the alloy samples was tested at 704° C. (1300° F.) and 552 MPa (80 ksi). The effect of thermal exposure on the mechanical properties of both solution treated and aged; and direct aged 718Plus® nickel-base alloys are presented in Table 6—Effect of Thermal Exposure on Mechanical Properties of Direct Aged Alloys.

As shown in Table 6, alloy samples treated to the direct aging processes showed enhancement in the 704° C. (1300° F.) tensile strength and stress-rupture life, as compared to alloy samples treated to the solution aging processes. Tensile yield strength of the direct aged material increased after thermal exposure at 760° C. (1400° F.) for 100 hours. For example, for direct aged alloy under direct aging process (1), the 704° C. (1300° F.) yield strength was initially 1057 MPa (153.4 ksi) and was 1082 MPa (157.0 ksi) after thermal exposure. For direct aged alloy under direct aging process (2), the 704° C. (1300° F.) yield strength was initially 1072 MPa (155.5 ksi) and was 1099 MPa (159.5 ksi) after thermal exposure. Stress rupture results showed a slight decrease in life for aging treatment (1) and an increase for aging treatment (2). This data suggests that thermal stability of alloy 718Plus® under direct aged processing is at least comparable to that of the alloy under solution treatment and aging processing.

TABLE 6

Effect of Thermal Exposure on Mechanical Properties of Solution-Aged and Direct-Aged Alloys

| | | | Tensile at 704° C. | | | | Stress Rupture 704° C./552 MPa | |
|---|---|---|---|---|---|---|---|---|
| Aging | Solution | Thermal Exposure | UTS (MPa) | YS (MPa) | EL (%) | RA (%) | Life (Hrs) | EL (%) |
| 741° C. × 8 hrs | 954° C. × 1 hr, | None | 1120 | 919 | 21.7 | 24.5 | 177.8 | 20.9 |
| FC at 55° C./hr | AC | 760° C. × 100 hrs | 1093 | 901 | 35.9 | 67.4 | 89.9 | 34.3 |
| to | None (DA) | None | 1215 | 1057 | 14.2 | 17.1 | 289.8 | 34.4 |
| 621° C. × 8 hrs, AC | | 760° C. × 100 hrs | 1229 | 1082 | 14.1 | 12.4 | 211.0 | 41.2 |
| 788° C. × 2 hrs | 954° C. × 1 hr, | None | 1111 | 904 | 22.5 | 26.4 | 100.0 | 44.5 |
| FC at 55° C./hr | AC | 760° C. × 100 hrs | 1068 | 873 | 37.8 | 47.3 | 86.6 | 41.4 |
| to | None (DA) | None | 1221 | 1072 | 15.1 | 16.4 | 261.3 | 40.4 |
| 650° C. × 8 hrs, AC | | 760° C. × 100 hrs | 1243 | 1099 | 13.2 | 12.2 | 385.9 | 26.6 |

Example 7

Enhancements in the mechanical properties of 718Plus® nickel-base alloys from the direct aging processes of the various embodiments of the present disclosure are also observed when the nickel-base alloys are cold worked at room temperature prior to the direct aging process. This Example shows that room temperature cold working when applied in addition to the working practices discussed earlier can increase the strength of the 718Plus® alloy compared to solution aging or direct aging alone.

In this Example, 718Plus® nickel-base alloy samples were worked with a 50% reduction in the finishing forging at 982° C.-996° C. (1800° F.-1825° F.). The alloy samples were then solution treated and aged, direct aged, or room temperature cold worked and direct aged. The solution treated and aged samples were solution treated at 843° C. (1550° F.) for 8 hours then 954° C. (1750° F.) for 1 hour, and air cooled. All of the samples (solution treated and aged; direct aged; and cold worked and direct aged) were aged at 788° C. (1450° F.) for 2 hours, cooled at a rate of 55° C./hr (100° F./hr) to 650° C. (1200° F.), maintained at 650° C. (1200° F.) for 8 hours and then air cooled to room temperature.

The 704° C. (1300° F.) tensile mechanical properties of the alloy samples were measured and the results tabulated in Table 7—Effect of Cold Rolling+Direct Aging on Tensile Property of Alloy 718Plus®.

As shown in Table 7, nickel-base alloy samples that were room temperature cold worked prior to direct aging showed enhanced strengths at 704° C. (1300° F.) as compared to both non-cold worked/direct aged and solution treated and aged alloy samples.

TABLE 7

Effect of Cold Rolling + Direct Aging on Tensile Properties of Alloy 718Plus ®

| | | 704° C. Tensile | | | |
|---|---|---|---|---|---|
| Finishing Forging | HT* | UTS (MPa) | YS (MPa) | EL (%) | RA (%) |
| 982° C. × 30 min, 50% Reduction | SA | 1102 | 923 | 16.4 | 23.4 |
| 982° C. × 30 min, 50% Reduction | DA | 1156 | 989 | 15.1 | 21.9 |

TABLE 7-continued

Effect of Cold Rolling + Direct Aging on Tensile Properties of Alloy 718Plus ®

| Finishing Forging | HT* | 704° C. Tensile UTS (MPa) | YS (MPa) | EL (%) | RA (%) |
|---|---|---|---|---|---|
| 996° C. × 30 min, 50% Reduction | CW + DA | 1328 | 1183 | 12.7 | 13.4 |

*Heat Treatment:
SA - 843° C. × 8 hrs + 954° C. × 1 hr, AC + 788° C. × 2 hrs, 55° C./hr Cool to 650° C., 650° C. × 8 hrs, AC
DA - 788° C. × 2 hrs, 55° C./hr cool to 650° C., 650° C. × 8 hrs, AC
CW + DA - 20% Cold Rolled + 788° C. × 2 hrs, 55° C./hr Cool to 650° C., 650° C. × 8 hrs, AC Although the foregoing description has necessarily presented a limited number of embodiments of the invention, those of ordinary skill in the relevant art will appreciate that various changes in the components, compositions, details, materials, and process parameters of the examples that have been herein described and illustrated in order to explain the nature of the invention may be made by those skilled in the art, and all such modifications will remain within the principle and scope of the invention as expressed herein and in the appended claims. It will also be appreciated by those skilled in the art that changes could be made to the embodiments described above without departing from the broad inventive concept thereof. It is understood, therefore, that this invention is not limited to the particular embodiments disclosed, but it is intended to cover modifications that are within the principle and scope of the invention, as defined by the claims.

We claim:

1. A method of processing a nickel-base alloy comprising, in percent by weight, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, and nickel; wherein a sum of the weight percent of molybdenum and the weight percent of tungsten is at least about 2% and not more than about 8%, and wherein a sum of atomic percent aluminum and atomic percent titanium is from about 2% to about 6%, a ratio of atomic percent aluminum to atomic percent titanium is at least about 1.5, and the sum of atomic percent aluminum and atomic percent titanium divided by atomic percent niobium is from about 0.8 to about 1.3, the method comprising:

working said nickel-base alloy into a desired shape; and direct aging said nickel-base alloy.

2. The method of claim 1, wherein working said nickel-base alloy into a desired shape comprises working said nickel-base alloy at a working temperature ranging from 913° C. to 1066° C.

3. The method of claim 2, wherein working said nickel-base alloy into a desired shape comprises working said nickel-base alloy at a working temperature ranging from 913° C. to 1038° C.; and wherein, after direct aging said nickel-base alloy, said nickel-base alloy has an increased yield tensile strength compared to a comparable solution treated and aged nickel-base alloy forged at the same temperature.

4. The method of claim 2, wherein working said nickel-base alloy into a desired shape comprises working said nickel-base alloy at a working temperature ranging from 982° C. to 1066° C.; and wherein, after direct aping said nickel-base alloy, said nickel-base alloy has an increased 704° C. rupture life compared to a comparable solution treated and aged nickel-base alloy forged at the same temperature.

5. The method of claim 2, wherein the method further comprises:

rapidly cooling said nickel-base alloy from the working temperature to 760° C.; and cooling said nickel-base alloy from 760° C. to room temperature.

6. The method of claim 5, wherein working said nickel-base alloy comprises at least one of forging, hot rolling, extruding, and swaging.

7. The method of claim 6, wherein working said nickel-base alloy further comprises re-heating said nickel-base alloy at a temperature ranging from 913° C. to 1066° C. prior to a final reduction pass.

8. The method of claim 5, wherein rapidly cooling said nickel-base alloy comprises cooling said alloy at a cooling rate of about 10° C./min to about 1667° C./min.

9. The method of claim 2, wherein working results in a final degree of deformation of greater than 10%.

10. The method of claim 9, wherein the final degree of deformation ranges from about 12% to about 67%.

11. The method of claim 2, wherein working said nickel-base alloy into a desired shape comprises room temperature cold working.

12. The method of claim 11, wherein room temperature cold working comprises at least one of cold rolling, cold drawing, forging, and swaging.

13. The method of claim 1, wherein direct aging said nickel-base alloy comprises:

heating said nickel-base alloy at a first direct aging temperature ranging from 741° C. to 802° C. for a time of at least 2 hours;

cooling said nickel-base alloy from the first direct aging temperature to a second direct aging temperature ranging from 621° C. to 718° C.;

heating said nickel-base alloy at the second direct aging temperature for a time of at least 8 hours; and cooling said nickel-base alloy from the second direct aging temperature to room temperature.

14. The method of claim 13, wherein cooling said nickel-base alloy from the first direct aging temperature to a second direct aging temperature comprises furnace cooling said nickel-base alloy.

15. The method of claim 13, wherein cooling said nickel-base alloy from the first direct aging temperature to a second direct aging temperature comprises cooling at a cooling rate of about 44° C./hr to about 67° C./hr.

16. The method of claim 1, wherein direct aging said nickel-base alloy comprises:

heating said nickel-base alloy at a first direct aging temperature ranging from 741° C. to 802° C. for a time of at least 2 hours;

cooling said nickel-base alloy from the first direct aging temperature to room temperatures;

re-heating said nickel-base alloy to a second direct aging temperature ranging from 621° C. to 718° C.;

heating said nickel-base alloy at the second direct aging temperature for a time of at least 8 hours; and cooling said nickel-base alloy from the second direct aging temperature to room temperature.

17. A method of processing a nickel-base alloy comprising, in percent by weight, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, and nickel; wherein a sum of the weight percent of molybdenum and the weight percent of tungsten is at least about 2% and not more than about 8%, and wherein a sum of atomic percent aluminum and atomic percent titanium is from about 2% to about 6%, a ratio of atomic percent aluminum to atomic percent titanium is at least about 1.5, and the sum of atomic percent aluminum and atomic percent titanium divided by atomic percent niobium is from about 0.8 to about 1.3, the method comprising:

working said nickel-base alloy into a desired shape; and direct aging said nickel-base alloy, wherein direct aging comprises:

heating said nickel-base alloy at a first direct aging temperature ranging from 741° C. to 802° C. for a time of at least 2 hours;

cooling said nickel-base alloy from the first direct aging temperature to a second direct aging temperature ranging from 621° C. to 718° C.;

heating said nickel-base alloy at the second direct aging temperature for a time of at least 8 hours; and cooling said nickel-base alloy from the second direct aging temperature to room temperature.

18. The method of claim 17, wherein cooling said nickel-base alloy from the first direct aging temperature to the second direct aging temperature comprises cooling said nickel-base alloy from the first direct aging temperature to room temperature and then reheating said nickel-base alloy to the second direct aging temperature.

19. The method of claim 17, wherein cooling said nickel-base alloy from the first direct aging temperature to the second direct aging temperature comprises cooling said nickel-base alloy at a cooling rate of about 44° C./hr to about 67° C./hr.

20. The method of claim 17, wherein working said nickel-base alloy comprises:

working said nickel-base alloy at a working temperature ranging from 913° C. to 1066° C., and wherein the method further comprises:

rapidly cooling said nickel-base from the working temperature to 760° C. at a cooling rate of about 10° C./min to about 1667° C./min, and cooling said nickel-base alloy from 760° C. to room temperature.

21. The method of claim 20, wherein working said nickel-base alloy comprises working said nickel-base alloy at a working temperature ranging from 913° C. to 1038° C.; and wherein, after direct aping said nickel-base alloy, said nickel-base alloy has an increased yield tensile strength compared to a comparable solution treated and aged nickel-base alloy forged at the same temperature.

22. The method of claim 20, wherein working said nickel-base alloy comprises working said nickel-base alloy at a working temperature ranging from 982° C. to 1066° C.; and wherein, after direct aping said nickel-base alloy, said nickel-base alloy has an increased 704° C. rupture life compared to a comparable solution treated and aged nickel-base alloy forged at the same temperature.

23. The method of claim 20, wherein working said nickel-base alloy further comprises re-heating said nickel-base alloy at a temperature ranging from 913° C. to 1066° C. prior to a final reduction pass.

24. The method of claim 20, wherein working said nickel-base alloy results in a final degree of deformation of greater than 10%.

25. The method of claim 24, wherein the final degree of deformation ranges from about 12% to about 67%.

26. The method of claim 20, wherein the working said nickel-base alloy comprises room temperature cold working said nickel-base alloy.

27. A method of forming an article of manufacture comprising:

working a nickel-base alloy comprising, in percent by weight, up to about 0.1% carbon, from about 12% to about 20% chromium, up to about 4% molybdenum, up to about 6% tungsten, from about 5% to about 12% cobalt, up to about 14% iron, from about 4% to about 8% niobium, from about 0.6% to about 2.6% aluminum, from about 0.4% to about 1.4% titanium, from about 0.003% to about 0.03% phosphorus, from about 0.003% to about 0.015% boron, and nickel; wherein a sum of the weight percent of molybdenum and the weight percent of tungsten is at least about 2% and not more than about 8%, and wherein a sum of atomic percent aluminum and atomic percent titanium is from about 2% to about 6%, a ratio of atomic percent aluminum to atomic percent titanium is at least about 1.5,and the sum of atomic percent aluminum and atomic percent titanium divided by atomic percent niobium is from about 0.8 to about 1.3, into a desired shape; and direct aging said nickel-base alloy, wherein direct aging comprises:

heating said nickel-base alloy at a first direct aging temperature ranging from 741° C. to 802° C. for a time of at least 2 hours;

cooling said nickel-base alloy from the first direct aging temperature to a second direct aging temperature ranging from 621° C. to 718° C.;

heating said nickel-base alloy at the second direct aging temperature for a time of at least 8 hours; and cooling said nickel-base alloy from the second direct aging temperature to room temperature.

28. The method of claim 27, wherein cooling said nickel-base alloy from the first direct aging temperature to the second direct aging temperature comprises cooling said nickel-base alloy to room temperature and then re-heating said nickel-base alloy to the second direct aging temperature.

29. The method of claim 27, wherein working said nickel-base alloy comprises:

working said nickel-base alloy at a working temperature ranging from 913° C. to 1066° C., and wherein the method further comprises:

rapidly cooling said nickel-base from the working temperature to 760° C. at a cooling rate of about 10° C./min to about 1667° C./min, and cooling said nickel-base alloy from 760° C. to room temperature.

30. The method of claim 29, wherein working said nickel-base alloy comprises working said nickel-base alloy at a working temperature ranging from 913° C. to 1038° C., and wherein, after direct aping said nickel-base alloy, said nickel-base alloy has an increased yield tensile strength compared to a comparable solution treated and aged nickel-base alloy forged at the same temperature.

31. The method of claim 29, wherein working said nickel-base alloy comprises working said nickel-base alloy at a working temperature ranging from 982° C. to 1066° C.; and wherein, after direct aping said nickel-base alloy, said nickel-base alloy has an increased 704° C. rupture life compared to a comparable solution treated and aged nickel-base alloy forged at the same temperature.

32. The method of claim 27, wherein the article of manufacture is selected from the group consisting of a turbine disk, a compressor disk, a blade, a shaft, and a fastener.

33. The method of claim 1, wherein working said nickel-base alloy comprises at least one of hot working, warm working, and cold working said nickel-base alloy.

34. The method of claim 17, wherein working said nickel-base alloy comprises at least one of hot working, warm working, and cold working said nickel-base alloy.

35. The method of claim 27, wherein working said nickel-base alloy comprises at least one of hot working, warm working, and cold working said nickel-base alloy.

* * * * *

UNITED STATES PATENT AND TRADEMARK OFFICE

CERTIFICATE OF CORRECTION

PATENT NO. : 7,531,054 B2
APPLICATION NO. : 11/221028
DATED : May 12, 2009
INVENTOR(S) : Richard L. Kennedy and Wei-Di Cao It is certified that error appears in the above-identified patent and that said Letters Patent is hereby corrected as shown below:

Title Page; item (56); Page 3; col. 2; line 13;

Other Publications, delete “Supperalloy” and substitute --Superalloy--

Col. 2, line 66, delete “embodiments” and substitute --embodiment--

Col. 4, line 3, delete “nickel-base from” and substitute --nickel-base alloy from--

Col. 4, line 47, delete “phases” and substitute --phase--

Col. 7, line 18, delete “ally” and substitute --alloy--

Col. 8, line 16, delete “raging” and substitute --ranging--

Col. 10, line 26, delete “nickel-based alloy” and substitute --nickel-base alloy--

Col. 22, line 1, delete “aping” and substitute --aging--

Col. 22, line 57, delete “temperatures;” and substitute --temperature;--

Col. 23, line 53, delete “aping” and substitute --aging--

Col. 23, line 60, delete “aping” and substitute --aging--

Col. 24, line 59, delete “aping” and substitute --aging--

UNITED STATES PATENT AND TRADEMARK OFFICE

CERTIFICATE OF CORRECTION

PATENT NO. : 7,531,054 B2
APPLICATION NO. : 11/221028
DATED : May 12, 2009
INVENTOR(S) : Richard L. Kennedy and Wei-Di Cao It is certified that error appears in the above-identified patent and that said Letters Patent is hereby corrected as shown below:

Col. 24, line 66, delete "aping" and substitute --aging--

Signed and Sealed this

Twenty-second Day of September, 2009

David J. Kappos

David J. Kappos
*Director of the United States Patent and Trademark Office*